US007131867B1

(12) United States Patent
Foster et al.

(10) Patent No.: US 7,131,867 B1
(45) Date of Patent: Nov. 7, 2006

(54) RF CONNECTORS HAVING GROUND SPRINGS

(75) Inventors: Nathan Foster, Wenatchee, WA (US); Anthony Meade, Wenatchee, WA (US)

(73) Assignee: Pacific Aerospace & Electronics, Inc., Wenatchee, WA (US)

( * ) Notice: Subject to any disclaimer, the term of this patent is extended or adjusted under 35 U.S.C. 154(b) by 0 days.

(21) Appl. No.: 11/123,370

(22) Filed: May 6, 2005

(51) Int. Cl.
*H01R 9/05* (2006.01)

(52) U.S. Cl. ..... 439/578; 439/95

(58) Field of Classification Search ..... 439/578, 439/95

See application file for complete search history.

(56) References Cited

U.S. PATENT DOCUMENTS

| | | | | |
|---|---|---|---|---|
| 3,587,029 | A | 6/1971 | Knowles | |
| 4,046,052 | A | 9/1977 | Nordstrom | |
| 4,049,902 | A | 9/1977 | de Ronde | |
| 4,125,308 | A | 11/1978 | Schilling | |
| 4,213,664 | A * | 7/1980 | McClenan | 439/95 |
| 4,636,015 | A | 1/1987 | Ford, Jr. | |
| 4,690,480 | A | 9/1987 | Snow et al. | |
| 4,721,481 | A | 1/1988 | Grellmann et al. | |
| 5,133,676 | A | 7/1992 | Hutchison et al. | |
| 5,298,683 | A | 3/1994 | Taylor | |
| 5,687,453 | A * | 11/1997 | Megregian et al. | 16/221 |
| 5,977,841 | A | 11/1999 | Lee et al. | |
| 6,039,580 | A | 3/2000 | Sciarretta et al. | |
| 6,048,212 | A | 4/2000 | Stauble et al. | |
| 6,053,744 | A | 4/2000 | Gray et al. | |
| 6,113,410 | A | 9/2000 | Heit et al. | |
| 6,234,688 | B1 | 5/2001 | Boger et al. | |
| 6,302,701 | B1 | 10/2001 | Miller, Jr. et al. | |
| 6,431,885 | B1 * | 8/2002 | Stroup | 439/94 |
| 6,441,706 | B1 | 8/2002 | Nelson | |
| 6,533,610 | B1 | 3/2003 | Dai et al. | |
| 6,597,902 | B1 | 7/2003 | Kawano | |
| 2003/0113075 | A1 | 6/2003 | Marquez et al. | |
| 2003/0196992 | A1 | 10/2003 | Demers et al. | |

* cited by examiner

*Primary Examiner*—Truc Nguyen
(74) *Attorney, Agent, or Firm*—Victor N. King; Ann W. Speckman; Speckman Law Group PLLC

(57) ABSTRACT

Radio frequency (RF) connectors and electronics housings and packages employing one or more inventive RF connector(s) provided herein utilize a ground spring to achieve improved conductivity of the ground signal by making a plurality of contacts with a ferrule member of the RF connector's hermetic feedthru and a plurality of contacts with the electronics housing or package at points adjacent to an air dielectric. Ground springs used in connection with the present RF connectors maintain predetermined spring properties under compression and/or extreme environmental conditions, including thermal fluctuations, and therefore may be suitably employed in aircraft and spacecraft.

37 Claims, 9 Drawing Sheets

RF CONNECTORS HAVING GROUND SPRINGS

BACKGROUND OF THE INVENTION

1. Technical Field of the Invention

The present invention relates generally to the field of electronics. More specifically, the present invention provides radio frequency (RF) connectors and electronics housings or packages employing one or more inventive RF connector(s). RF connector(s) disclosed herein utilize a ground spring to achieve improved conductivity of the ground signal by making a plurality of contacts with a ferrule member of the RF connector's hermetic feedthru and a plurality of contacts with the electronics housing or package at points adjacent to an air dielectric. Ground springs used in connection with the RF connectors of the present invention maintain predetermined spring properties under compression and/or extreme environmental conditions, including thermal fluctuations, and therefore may be suitably employed in aircraft and spacecraft.

2. Description of the Related Art

Electronic components are used in countless applications in a wide variety of environments. Such components are subject to faulty operation, degradation, and corrosion resulting from contact with dust, water vapor, gases, and the like, as well as from high temperature and/or pressure conditions. In order to protect electronic components from such harsh conditions of the operating environment, they are generally, although not exclusively, hermetically sealed within an electronics housing or package that is desirably constructed from materials that meet application specific requirements for density, thermal expansion, thermal conductivity, mechanical strength, and the like. For example, electronics packages used in aircraft and spacecraft applications must be lightweight and are therefore constructed from low density materials such as aluminum or titanium alloys.

Commonly, electronic components on the inside of an electronics housing or package are in electrical contact with components on the exterior of the package by way of an electrical connector, such as an RF connector, that incorporates a hermetic feedthru to maintain the integrity of the electronics housing or package interior. The basic elements of representative prior art "spark plug" and "field replaceable" RF connectors are presented in FIGS. 1A and 1B, respectively.

FIG. 1A depicts a typical "spark plug" type RF connector 10 with a hollow, exteriorly threaded stainless steel shell 12 having a KOVAR™ glass-to-metal feedthru 14 affixed thereto by brazing at elevated temperature. Shell 12 also houses a teflon (or other insulating material) insert 16 having a pin socket 18 disposed therein at each longitudinal end. A connector pin 20, generally formed of an iron-based metal, inserts into pin socket 18. A teflon member 22 surrounds connector pin 20 in longitudinal juxtaposition to shell 12, and a double knife edge seal ring 24 is disposed in circumferential juxtaposition to shell 12. Ring 24 is formed of an iron-based metal, such as KOVAR™ or stainless steel, and is optionally coated with silver.

To affix RF connector 10 to an interiorly threaded electronics housing or package 26, torque (approximately 25 in-lbs) is applied to RF connector 10. This force causes seal ring 24 to slightly cut into both RF connector 10 and electronics housing or package 26, thereby creating a seal. To insure that RF connector 10 does not back out of electronics housing or package 26 during transport or use, an edge 28 of an RF connector 10-electronics housing or package 26 assembly is soldered about the circumference of RF connector 10. For this purpose, gold plating is optionally used to improve the wetting properties of the solder.

Because of the differing thermal expansion properties of the electronics housing or package and prior art "spark plug" type RF connector, i.e. the externally threaded iron-based metal and the internally threaded aluminum metal, the seal between these components does not reliably maintain its hermeticity. The two dissimilar metals are in intimate contact at ambient temperature; however, since aluminum has a higher expansion rate than does either KOVAR™ or stainless steel, temperatures lower than ambient cause package 26 to squeeze RF connector 10, while temperatures higher than ambient produce a separation between those components. Such phenomena result in fatigue of the solder joint during thermal cycling and cause less than intimate contact between seal ring 24 and electronics housing or package 26 as well as between seal ring 24 and RF connector 10.

Furthermore, the external solder application at 28 prevents RF connector 10 backout by providing a mechanical lock between the components, but because of material fatigue this solder joint also does not form a reliable hermetic seal. And, this RF connector is not field replaceable because removal of the connector compromises the hermeticity of the package and breaks the rigid connection to the end of the pin located inside the package. That is, RF connector 10 cannot be replaced in the field without a high risk of compromising the integrity of electronics housing or package 26 circuitry.

Significant in regards to the presently disclosed invention, the electrical performance of RF connector 10 suffers as a result of temporal disparity owing to differences in lengths of the conductance path of the RF signal and the ground signal to electronics housing or package 26. While the RF signal follows an essentially straight line path through RF connector 10 into electronics housing or package 26 by way of the pin member 20, the ground path must run along the outer surface of teflon insert 16, the outer surface of the glass portion of feedthru 14, the outer surface of teflon member 22, through seal ring 24 into electronics housing or package 26 and about the periphery of the interior of package 26 to the ground location within the electronics housing or package. The resulting ground lag impacts signal gain and loss characteristics, thereby affecting the signal-to-noise ratio. This problem is exacerbated as higher frequency signals are employed.

FIG. 1B depicts a prior art "field replaceable" RF connector 30, which includes an exteriorly threaded, replaceable portion 32 formed of stainless steel. A KOVAR™ glass-to-metal feedthru 34 is soldered into a cavity 36 in an aluminum electronics housing or package 38 at one or more solder locations 40. Replaceable portion 32 is torqued into an interiorly threaded aluminum portion 42.

As described above with respect to the prior art "spark plug" type RF connector of FIG. 1A, seals using field replaceable connectors 30 are hermetic at ambient temperature, but because of the approximately 4:1 thermal expansion mismatch between KOVAR™ and aluminum, the hermeticity of the KOVAR™-aluminum solder seal fails due to metal fatigue with repeated temperature variations. Moreover, connector 30 does not meet military field replaceability standards because an iron-based metal part may be threaded into aluminum only once, because that operation impacts subsequent torque applications by displacing the aluminum in the threaded area.

In an attempt to overcome limitations in prior art RF connectors owing to metal mismatching and fatigue of solder connections, laser welding, rather than soldering, of RF connectors has been utilized to achieve reliable hermetic packaging. For example, RF connectors have been designed to be laser welded directly into an electronics housing or package thus eliminating hermetic failure due to solder joint fatigue. See, e.g., U.S. Pat. No. 5,298,683 to Taylor. Laser welding provides further advantages because the heating is localized at the weld, which permits the enclosure to be welded without damage to the delicate instruments and electronics installed inside. The localized heating also precludes weld induced thermal distortion of the enclosure and obviates the introduction of flux or other contaminants into the enclosure. And, the laser welding process lends itself well to automation for high production rates and low cost.

A limitation of RF connectors stemming from the use of laser welding that has not been adequately addressed in the art, however, is that laser welds, unlike solder joints, do not form a suitable ground path between an RF connector and the electronics housing or package to which it is welded. Thus, the ground lag seen in prior art RF connectors, as described above, that results from differences in signal and ground path lengths significantly compromises the RF connector's signal to noise ratio. What is needed in the art, therefore, are RF connectors having improved ground path conductivity properties.

SUMMARY OF THE INVENTION

The present invention addresses these and other related needs by providing RF connectors, principally laser welded RF connectors, that employ improved ground springs to facilitate electrical conductance of a ground signal from the RF connector to an electronics housing or package. RF connectors of the present invention may be suitably employed to form a hermetic seal with a lightweight electronics housing or package, such as an electronics package fabricated out of an aluminum or titanium alloy, and will find use in applications in which the electronics housing or package is exposed to extreme environmental conditions, such as highly corrosive conditions and/or conditions of large thermal variance, as are encountered by aircraft and spacecraft.

Thus, within certain embodiments, the present invention provides RF connectors comprising a hermetic feedthru having two layers wherein the feedthru is fabricated out of a metallic ferrule member and non-conductive dielectric member. Typically, the dielectric member is cylindrical in shape and is fabricated to include a longitudinal channel to accommodate a pin member. Dielectric members may be fabricated out of a material selected from the group consisting of glass, such as Corning Glass No. 7070, while the metallic ferrule member may be fabricated out of a material selected from the group consisting of iron and an iron alloy such as KOVAR™ or stainless steel. Pin members are normally made of iron or an iron alloy.

RF connectors exemplified herein are fabricated from laminated dissimilar metal sheets wherein a first metal layer, constituting the majority of the sheet thickness, is metallurgically bonded to a second metal layer. The first metal layer is, most commonly, iron or an iron alloy such as a KOVAR™ or a stainless steel while the second metal layer is, most commonly, an aluminum or titanium alloy. Typically, a first face of the first metal layer is bonded to the second metal layer through the manufacturing process of explosion welding or roll bonding. While on its opposite, second face, the first metal layer is bonded, typically through laser welding, to the ferrule member of the hermetic feedthru. Similarly, the second metal layer is most often laser welded to the electronics housing or package.

RF connectors of the present invention are commonly used in combination with electronics housing or packages fabricated from lightweight aluminum alloys, such as AlSi, titanium, titanium alloys, and/or KOVAR™ to maintain the hermeticity of the electronics package while permitting conduction of an electrical signal from the inside of the electronics package to the exterior environment. Within certain embodiments, weldable KOVAR™ packages may be preferred owing to KOVAR's reworkability. As exemplified herein, electronics housings or packages comprise a dielectric material to receive the RF connector pin and to insulate the pin from the electronics housing or package. Most commonly, the electronics housing or package dielectric is an air dielectric.

RF connectors disclosed herein further comprise a highly conductive ground spring member to achieve improved conductance of a ground signal by forming a plurality of first contacts with the ferrule member of the RF connector and a plurality of second contacts with the electronics housing or package. That is, ground springs of the present invention permit the formation of an improved ground connection between the ferrule of the RF connector's hermetic feedthru and the electronics housing or package at points adjacent to the dielectric of the electronics housing or package all the while maintaining the hermeticity of the seal between the RF connector and the electronics housing or package.

Suitable ground springs according to the present invention exhibit good electrical conductivity and are commonly, but not exclusively, made of stainless steel, including gold- or silver-plated stainless steel, or a copper alloy such as, for example, a beryllium-copper alloy including, but not limited to, an alloy comprising 1% Beryllium and 99% Copper (ASTM B194). Ground springs presented herein are also capable of maintaining spring characteristics and maintaining spring force under compression conditions as well as under extreme thermal fluctuations.

Depending upon the precise application contemplated, ground springs may be generally circular in shape with a plurality of circumferentially disposed petal elements thereby facilitating the formation of a plurality of first and second circumferential contacts, respectively, with the ferrule member of the hermetic feedthru and electronics housing or package while simultaneously retaining spring characteristics under compressive force. Alternatively, ground springs may be coiled springs, which are suitable for applications requiring increased mechanical stability and still greater numbers of first and second circumferential contacts with the ferrule member and the electronics housing or package, respectively. Within one embodiment of the present invention, the ground spring is a funnel-shaped formed ground spring that is fabricated such that it is integral with the air dielectric of the electronics housing or package

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings in which:

FIGS. 9A and 9B depict a section of a coil ground spring before (FIG. 9A) and after (FIG. 9B) compression. FIG. 9C depicts a top plan view and FIG. 9D depicts a cross-sectional view of an exemplary coil ground spring. FIG. 9E depicts a cross-sectional view of an inventive RF connector employing a coil ground spring shown prior to full engagement.

DESCRIPTION OF PREFERRED EMBODIMENTS

The present invention is directed to RF connectors that may be employed in conjunction with lightweight, hermetically sealed electronics housing or packages suitable for use in extreme environmental conditions such as those encountered by aircraft and spacecraft. RF connectors presented herein employ one or more ground spring in order to achieve improved conductance of the ground signal from an RF connector to an electronics housing or package. Such inventive RF connectors achieve the practical and reliable installation of hermetic feedthrus into electronics housing or packages by substantially matching the material and/or thermal expansion properties of the electronics housing or package to the corresponding parameters of the inventive RF connector while incorporating one or more ground spring, as disclosed herein, to achieve a more direct ground path.

As used herein, the term "RF connector" connotes the main body of an RF connector, with a pin insert or other pin interface, such as a feedthru, in place; the terms "electronics package" or "electronics housing" (used interchangeably herein) connote one of the components with which the RF connector is to interface; and the term "electronics assembly" connotes the interfaced RF connector-electronics housing or package assembly.

Although the present invention is described below in terms of accomplishing an aluminum alloy-based electronics package-iron-based metal component interface, it will be apparent to one of skill in the art that the principles of the present invention may be employed in other dissimilar metal applications, involving metals such as titanium and titanium alloys and the like.

As a result of the substantial thermal expansion property matching between the electronics assembly components when an RF connector of the present invention is employed, and the use of laser welding to assemble individual RF connector members, failure of the hermetic seals, as is typically seen with solder connections, are generally avoided. Thus, RF connectors presented herein are advantageously employed in applications requiring the re-workability of the hermetic seal.

Figure 1A:
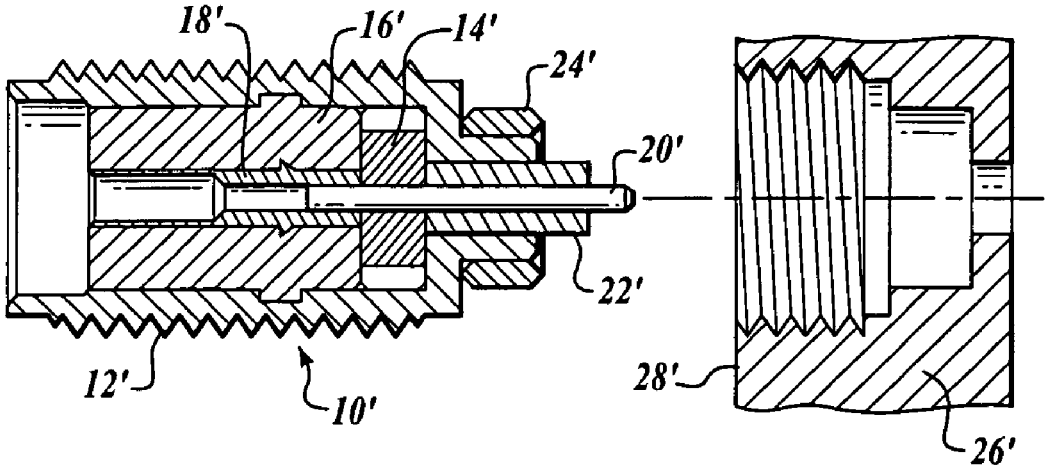
FIG. 1A (PRIOR ART)
FIG. 1A is a cross-sectional view of a prior art sparkplug-type RF connector.
Figure 1B:
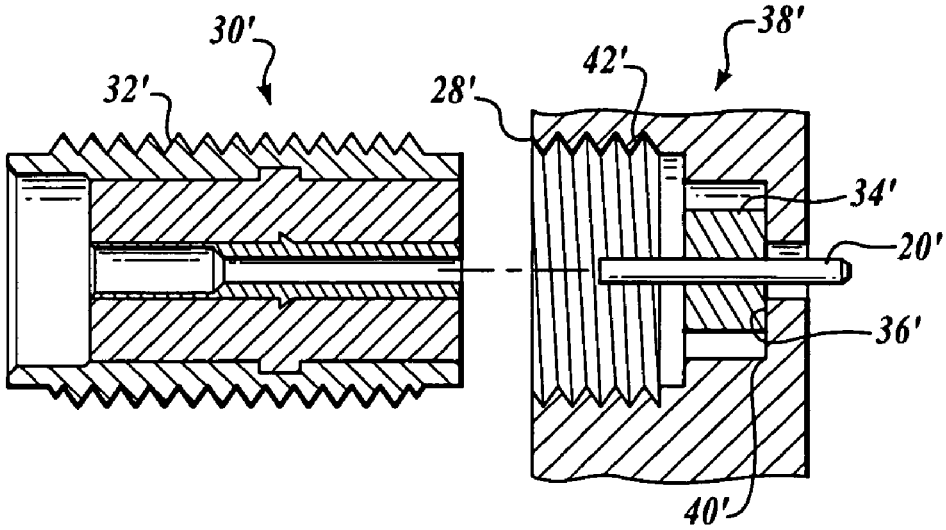
FIG. 1B (PRIOR ART)
FIG. 1B is a cross-sectional view of a prior art field-replaceable RF connector.
Figure 2:
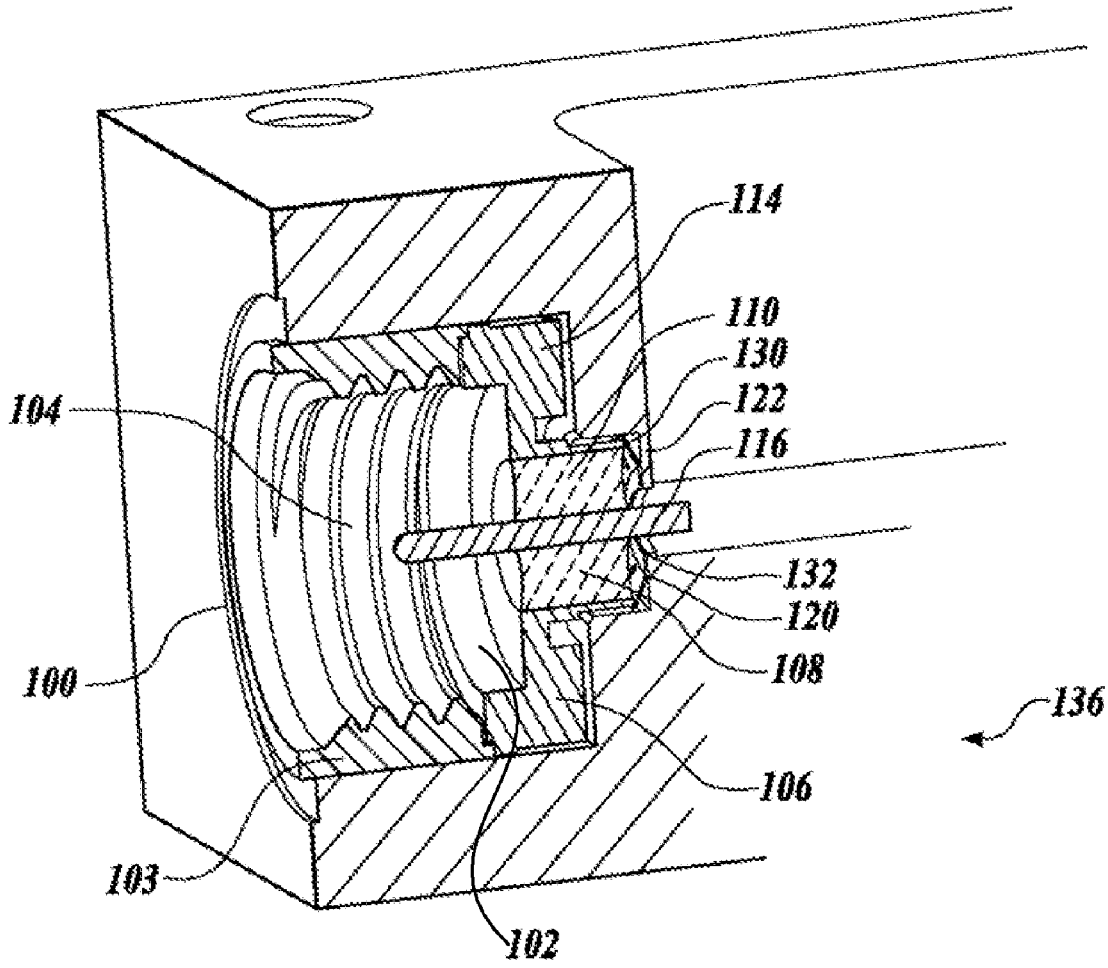
FIG. 2 is a cross-sectional view of an inventive RF connector employing a compressed form ground spring shown prior to full engagement.
Figure 3:
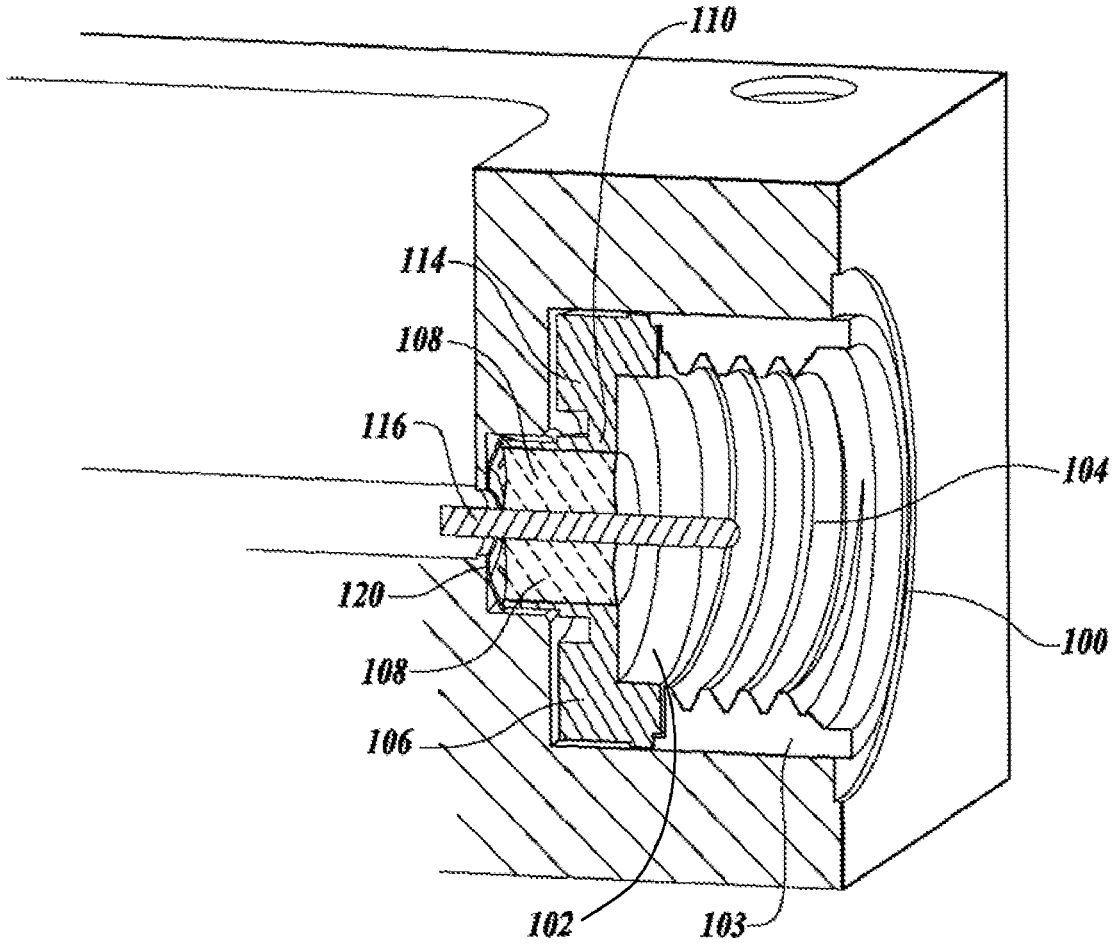
FIG. 3 is a cross-sectional view of the RF connector presented in FIG. 2 shown fully engaged.

FIG. 2 depicts an exemplary RF connector 100 embodiment of the present invention and shows the position of the RF connector 100 prior to full engagement with electronics housing or package 136. FIG. 3 depicts the same RF connector as in FIG. 2 showing the RF connector 100 in a fully engaged position. RF connector 100 is characterized by a first metal layer 102 and a second metal layer 103, machined to include a threaded portion 104. First metal layer 102 is generally an iron-based metal such as KOVAR™ while second metal layer 103 is generally aluminum or an aluminum alloy, but it will be understood that other dissimilar metal combinations may also be employed. A first face of first metal layer 102 is typically laminated or explosion welded to a face of second metal layer 103 and a second face of first metal layer 102 is laser welded to ferrule member 106 of hermetic feedthru 114. Attachment of RF connector 100 to electronics housing or package 136 may be accomplished through laser welding of the second metal layer 103 and electronics housing or package 136.

Ferrule member 106 of hermetic feedthru 114 houses a dielectric member 108, which is generally cylindrically shaped, formed of a suitable material such as Corning Glass No. 7070, and fabricated to exhibit a channel 110 for accepting and sealing pin member 116. Subsequent to sealing pin member 116 into dielectric member 108, the dielectric member 108 is fired into ferrule member 106 to generate a hermetic feedthru. Ferrule member 106 may be larger in circumference than the interiorly threaded portion 104 of explosion welded first and second metal layers 102 and 103, as shown in FIG. 2 and is preferably formed of an iron-based metal such as KOVAR™.

Ground spring 120 is formed of a conductive material and makes a plurality of first circumferential contacts 130 with ferrule member 106 and a plurality of second circumferential contacts 132 with electronics housing or package 122. Suitable conductive materials for fabricating ground springs of the present invention include copper alloys, such as beryllium copper alloys, preferably fully heat treated beryllium copper alloys. One such exemplary beryllium copper alloy used to fabricate ground springs disclosed herein comprises about 1% beryllium and about 99% copper. A particularly suitable beryllium copper alloy for such applications is beryllium copper alloy No. 172 (ASTM B194). Other copper alloys, including other beryllium copper alloys, may also be used to fabricate ground springs that are within the scope of the present invention so long as they comprise materials of high electrical conductivity and are capable of maintaining spring properties under compression.

Figure 4:
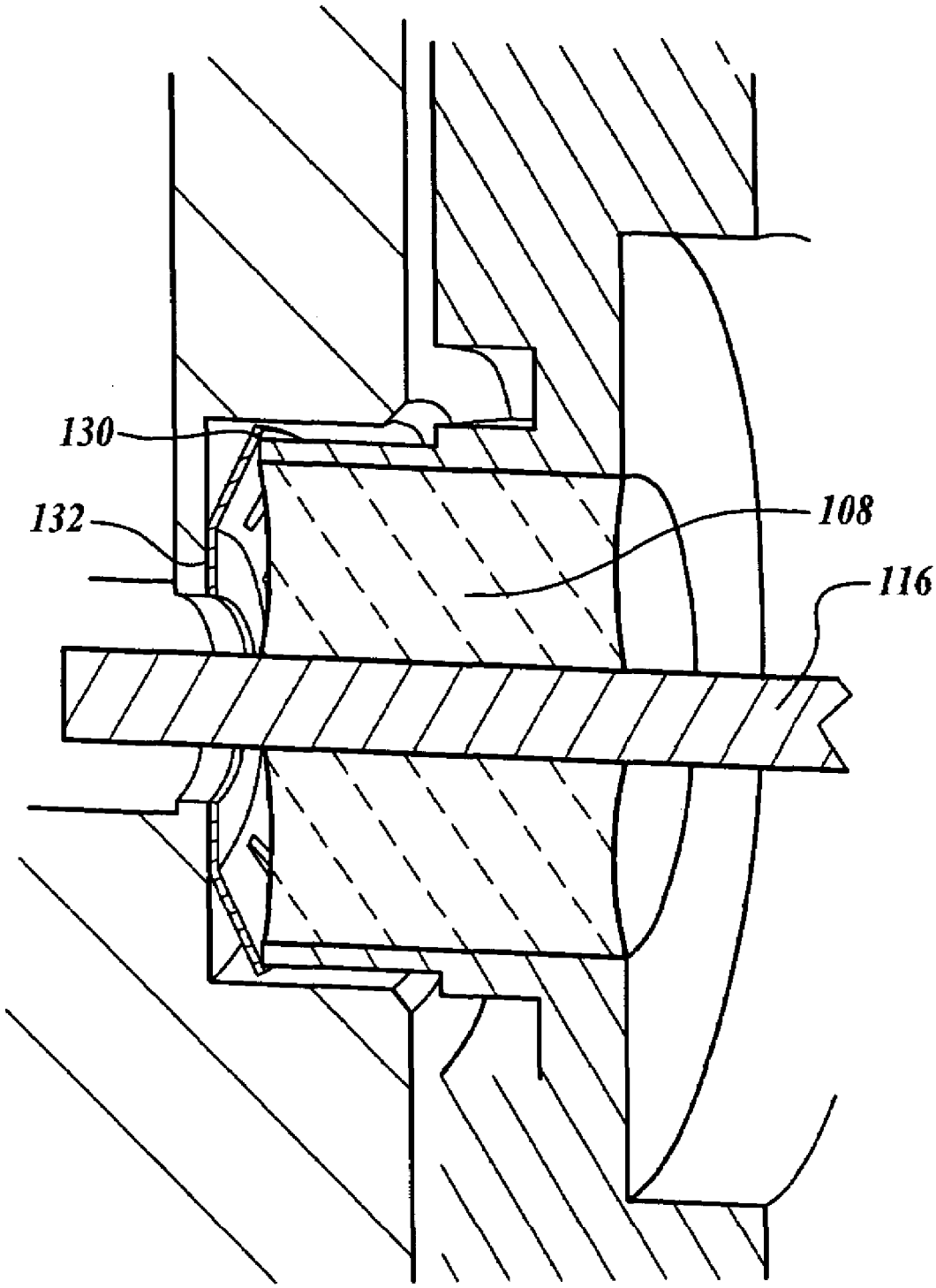
FIG. 4 is a cross-sectional view of the RF connector presented in FIG. 2 showing the ground path detail.

See, FIG. 4 showing the ground path detail following full engagement of RF connector 100, which results in formation of a plurality of first and second contacts between ground spring member 120 with ferrule member 106 and electronics housing or package 136 at a plurality of points adjacent to air dielectric 138, respectively. Ground spring 120 provides substantial advantages over prior art RF connectors by substantially reducing the length of the RF ground signal path and by being uniquely suited to perform well over thermal fluctuations and consequent material movement through it's spring properties of the hermetic feedthru with respect to the electronics housing or package.

Figure 7A:
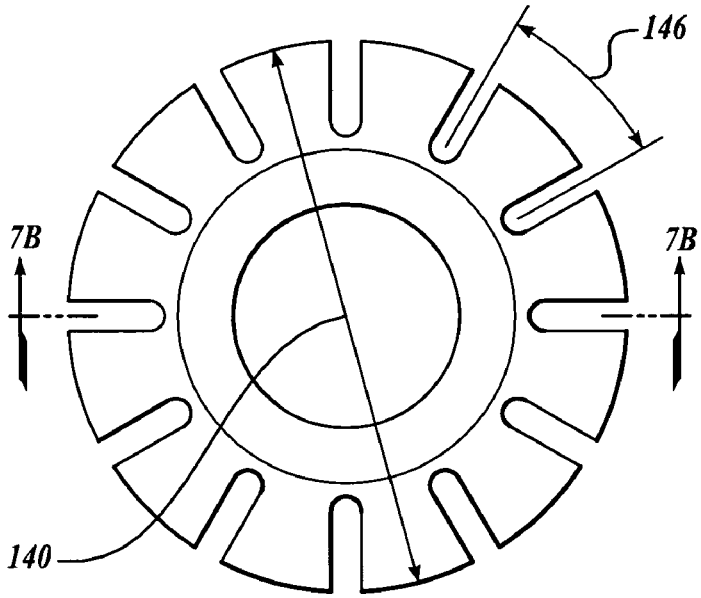
FIG. 7A depicts a top plan view and FIG. 7B depicts a cross-sectional view of a formed ground spring of the present invention.
Figure 7B:
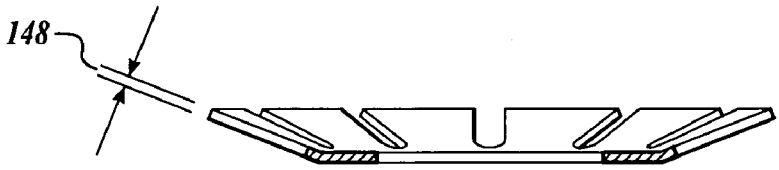

Ground springs 120 of the present invention may be formed ground springs. Exemplary ground springs 120 suitable for use with the RF connectors disclosed herein are presented in FIG. 7. Typically, ground springs are generally circular in shape and are defined by an outside diameter (OD) 140. Ground springs are also fabricated to include a hole to receive pin member 116 that is concentric with the circumference of the ground spring defined by the OD such that the ground springs also have an inside diameter (ID) 142. ODs 140 generally range from between about 0.080±0.0005 inches and 0.200±0.0005 inches, more commonly between about 0.090±0.0005 inches and 0.150±0.0005 inches, and still more commonly between about 0.098±0.0005 inches and 0.124±0.0005 inches. IDs 142 generally range from between about 0.020±0.0005 inches and 0.100±0.0005 inches, more commonly between about 0.030±0.0005 inches and 0.080±0.0005 inches, and still more commonly between about 0.030±0.0005 inches and 0.050±0.0005 inches.

Figure 8A:
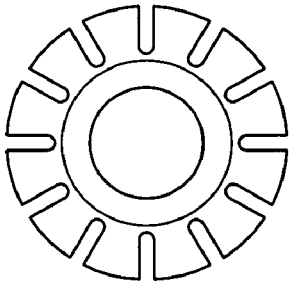
FIGS. 8A, 8B, and 8C depict top plan views of alternative embodiments of the formed ground sprigs of the present invention containing 12, 6, and 8 petals, FIGS. 8A, 8B, and 8C, respectively.
Figure 8B:
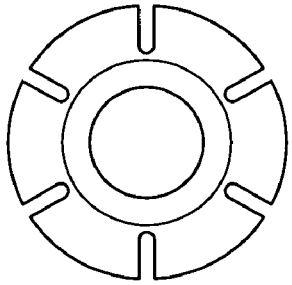
Figure 8C:
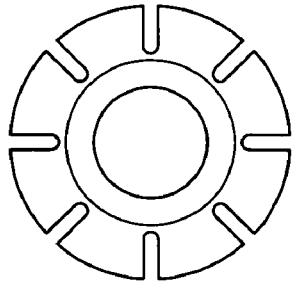
Figure 9A:
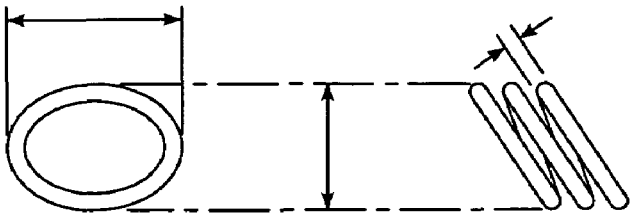
FIGS. 9A–9E depicts various aspects of a coil ground spring of the present invention.
Figure 9B:
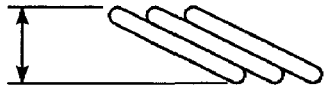
Figure 9C:
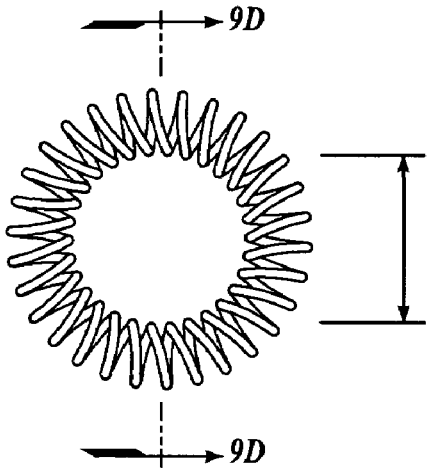
Figure 9D:
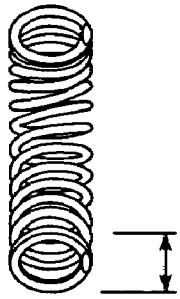
Figure 9E:
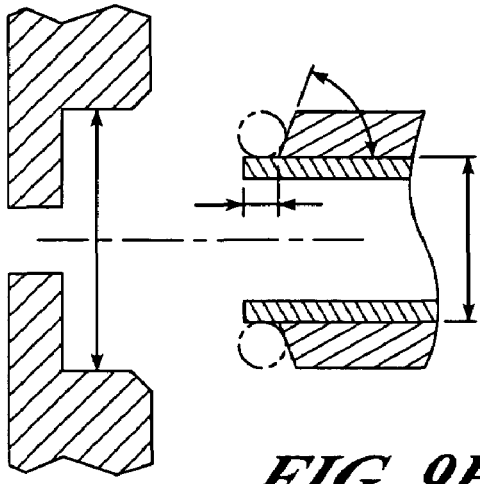

Formed ground springs disclosed herein generally comprise a plurality of petals 144. Typically, formed ground springs comprise between 4 and 20 petals, more commonly between 6 and 12 petals. Exemplary formed ground springs presented herein in FIGS. 8A–8C have 12, 6, or 8 petals, respectively. Petals are typically disposed at an acute angle 146 from the plane of the ground spring. Typically, petals are disposed at an angle of between about 30° and 60° from the plane of the ground spring. Exemplary formed ground springs presented herein in FIGS. 7 and 8 have petals that are disposed at angles of 30°, 45°, or 60°. Other acute angles are also suitable for formed ground springs of the present invention.

Typically, formed ground springs are fabricated out of a sheet of a suitable conductive material, as described herein above, having a thickness 148 of between about 0.0010±0.0005 inches and about 0.0050±0.0005 inches, more commonly between about 0.0015±0.0005 inches and about 0.0030±0.0005 inches. Exemplary sheets of conductive material used to fabricate the formed ground springs presented herein were about 0.0020±0.0005 inches.

Table 1, below, summarizes exemplary suitable dimensions of formed ground springs of the present invention.

TABLE 1

Dimensions of Exemplary Formed Ground Springs 120

| OD 140 | ID 142 | Number of Petals 144 | Petal Angle 146 | Ground Spring Thickness 148 |
|---|---|---|---|---|
| 0.124 + 0.0005 inches | 0.050 + 0.0005 inches | 12 | 30° | 0.0020 + 0.0005 inches |
| 0.098 + 0.0005 inches | 0.035 + 0.0005 inches | 6 | 60° | 0.0020 + 0.0005 inches |
| 0.098 + 0.0005 inches | 0.040 + 0.0005 inches | 8 | 45° | 0.0020 + 0.0005 inches |
| 0.098 + 0.0005 inches | 0.030 + 0.0005 inches | 6 | 60° | 0.0020 + 0.0005 inches |

It will be appreciated by those of skill in the art that RF connectors, in particular RF connector pin diameter, vary in size depending upon frequency performance requirements. That is, higher frequencies require smaller pin diameters. And, pin diameter variances require corresponding dielectric diameter changes. These factors directly impact the size of the ground spring of the present invention that is required in order to maintain electrical contact at a plurality of points as described herein. Furthermore, as frequency increases, the total relative electrical contact between the ground spring 130 and the ferrule element 108 becomes more critical.

Figure 5:
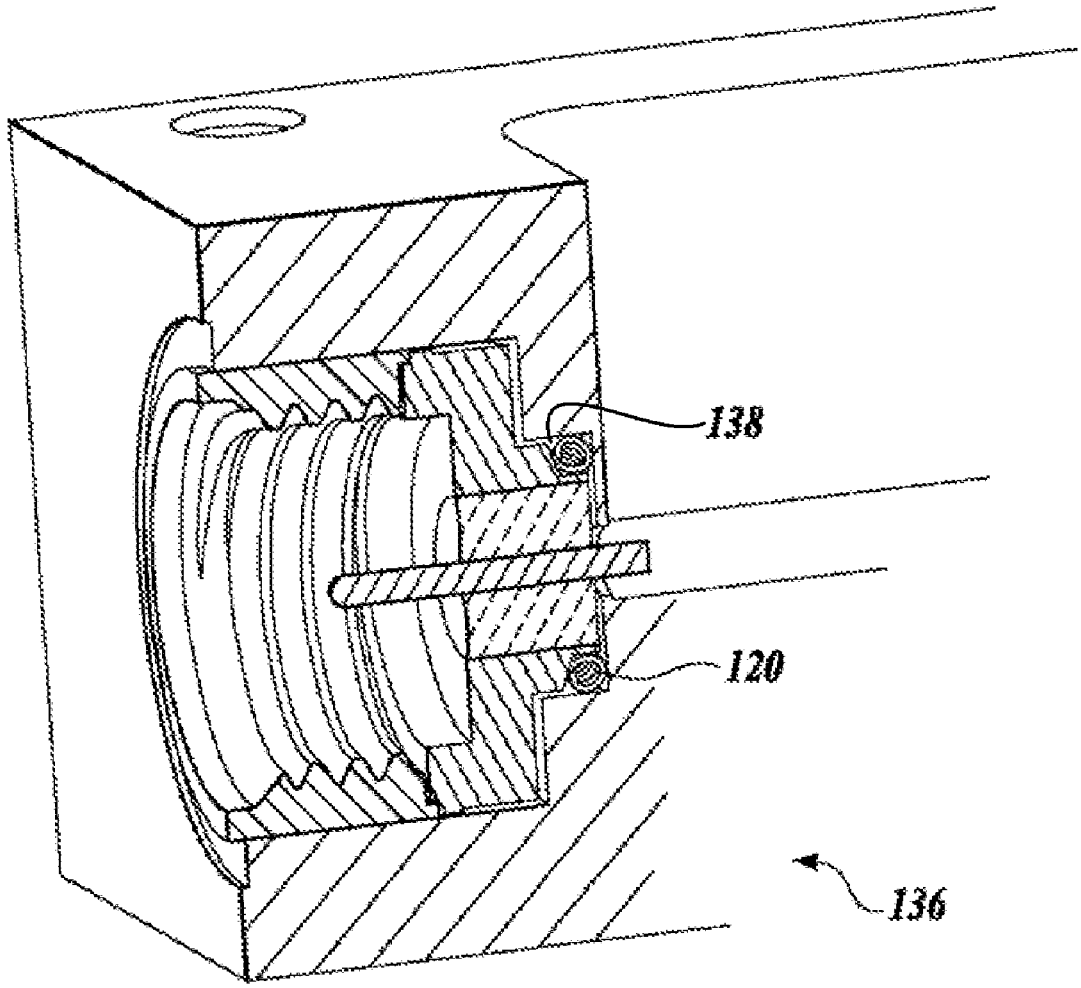
FIG. 5 is a cross-sectional view of an inventive RF connector employing a coil ground spring and electronics housing.
Figure 6:
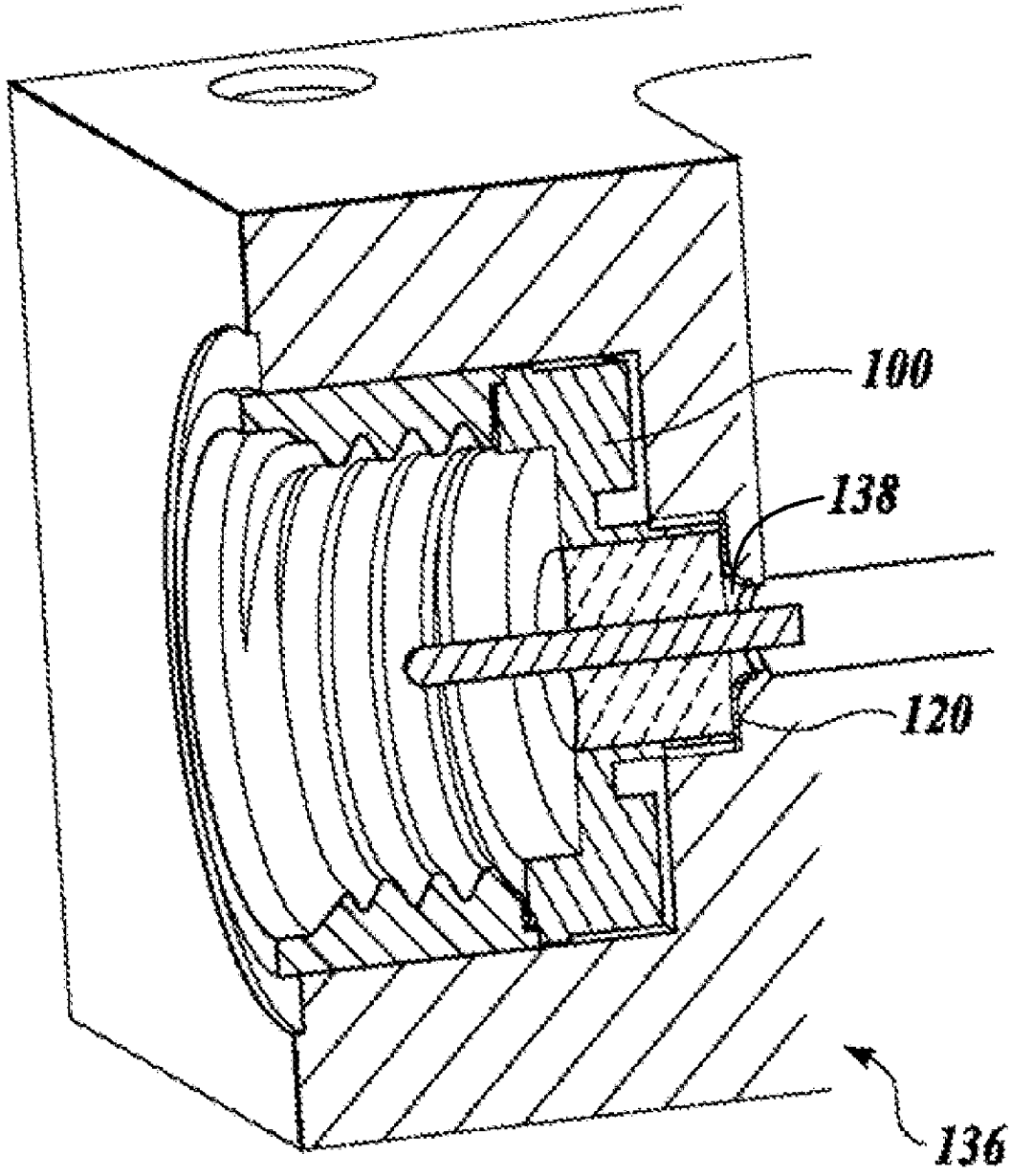
FIG. 6 is a cross-sectional view of an inventive RF connector employing a compressed form ground spring having a plurality of direct points of contact with the air dielectric and wherein the spring is integrated into the air dielectric.
Figure 10A:
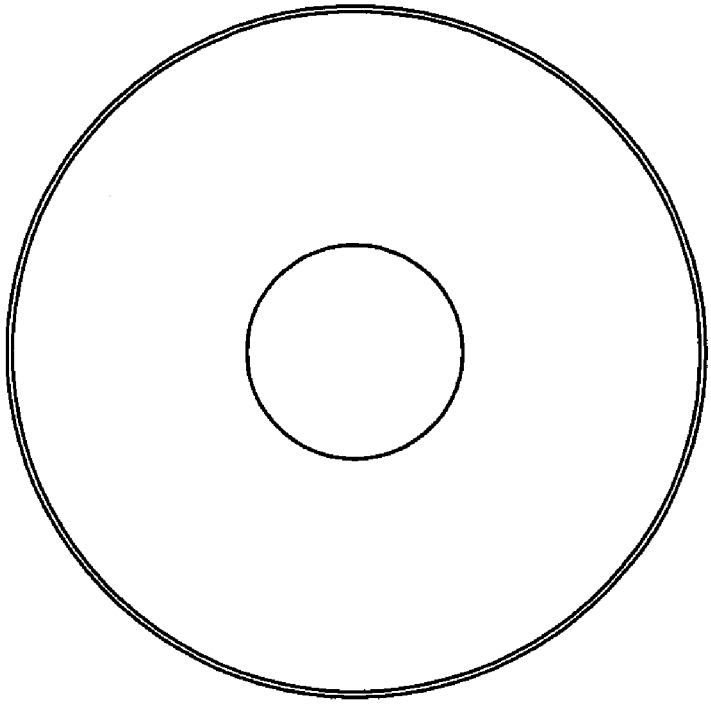
FIG. 10A depicts a top plan view and FIG. 10B depicts a cross-sectional view of a funnel-shaped formed ground spring of the present invention.
Figure 10B:
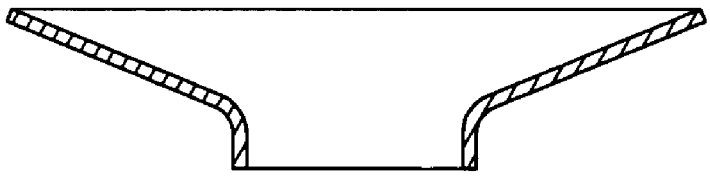

FIGS. 5 and 9 depict an alternative embodiment of the present invention wherein the ground spring 120 is a coil spring. FIGS. 6 and 10 depict an embodiment of the present invention wherein the ground spring 120 is a funnel-shaped ground spring fabricated to contact the electronics housing package 136 at a plurality of points at air dielectric 138 thereby further reducing the length of the corresponding ground signal path.

The ground path of RF connector 100, shown in FIG. 2, is along the outer surface of first metal layer 102 and second metal layer 103, along the outer surface of the dielectric portion of hermetic feedthru 114, through ground spring 120, and into electronics housing or package 136 at points adjacent to air dielectric 138. Due to the incorporation of a conductive ground spring 120 of the present invention, the electrical performance of RF connector 100 exceeds that of prior art RF connectors of similar design such as those RF connectors disclosed in U.S. Pat. No. 5,298,683 to Taylor, which is incorporated herein by reference in its entirety. RF connector 100 is characterized by an essentially straight line signal path from ferrule member 106 to electronics housing or package 136 thereby exhibiting a shorter ground path and consequent reduction in the ground lag and improved signal to noise ratio as compared to prior art RF connectors.

Hermetic feedthrus 114 useful in the practice of the present invention are well known in the art and are commercially available. For example, glass-to-metal hermetic feedthrus formed, for example, from a dielectric 108 of Corning Glass No. 7070 glass (Corning Glass Works; Corning, N.Y.) and a KOVAR™ ferrule 106 may be produced substantially as described in U.S. Pat. No. 4,352,951, which is incorporated herein by reference in its entirety. Size modification of commercial feedthrus may be necessary to best accommodate all applications of the present invention. Such modifications may be routinely made by one of skill in the art.

In addition, any known pre- or post-weld production steps may be employed, if desirable for the specific application in which the connector of the present invention is to be used. A skilled artisan is therefore capable of producing an RF connector-electronics housing or package interface to form an electronics assembly in accordance with this embodiment of the present invention.

Furthermore, one of skill in the art is capable of achieving laminated explosion welded and laser welded interfaces between members of the presently described RF connectors and electronics housing or packages comprising such RF connectors to form electronics assemblies in accordance with the presently disclosed embodiments of the present invention.

A suitable laser welding machine may be obtained from Humonics, Inc. (Rancho Cordova, Calif.). For example, a Pulsed Nd:YAG Laser capable of up to 150 watts average power, set to pulse at about 20 pulses per second at a power setting of 1 joule per pulse may be employed. A computer may be used to guide the laser at the weld area while a collar machine tool chuck rotates the assembled enclosure.

An exemplary suitable manufacturing procedure for explosively bonding composite metals is described in U.S. Pat. No. 5,323,955 to Bergmann et al., which is incorporated herein by reference in its entirety, and is well known to and routinely practiced by those of skill in the art. Briefly, explosive welding is a solid state welding process that uses a controlled explosive detonation to force two dissimilar metals together. The resultant metal composite is joined with a durable, metallurgical bond. To achieve an explosion weld, a jetting action is required at the collision interface. This jet is the product of the surfaces of the two pieces of metals colliding and allows dissimilar metallic surfaces to permanently bond under extremely high pressure.

As used herein, the term "thickness" connotes the dimension of an RF connector aligned with the plane of the dissimilar metal sheet from which the RF connector is fabricated, while the term "height" connotes the dimension of an RF connector aligned with the transverse plane thereof.

Generally, the dimensions of RF connector 100 are related to the thickness of the wall of the electronics housing or package 136 with which RF connector 100 is to interface. Conventional RF connectors interface with 0.250 in. thick electronics housing or package walls. RF connectors 100 of the present invention are capable of interfacing with thinner electronics housing or package walls, e.g., walls from about 0.100 in. to 0.125 in. thick. Another factor influencing RF connector 100 dimensions is the interface between connector 100 and components external to the electronics package. More specifically, connector 100 must be of a design compatible with external components to provide electrical communication between such components and components housed within the electronics package.

Preferably, RF connector 100 is formed of a second metal layer 103, generally fabricated out of an aluminum or titanium alloy and having a thickness ranging from about 0.400 in. to about 0.600 in., with about 0.400 in. to about 0.500 in. more preferred, and a first metal layer 102, generally fabricated out of an iron alloy and having a thickness preferably ranging from about 0.010 in. to about 0.200 in., with from about 0.080 in. to about 0.100 in. more preferred. Additional metal layers that may be optionally included in dissimilar metal sheets forming RF connectors 100 useful to accomplish aluminum-to-iron interface are titanium, silver, palladium or the like. Such additional metal layers preferably range from about 0.025 in. to about 0.030 in. in thickness. The total length of RF connector 100 therefore ranges from about 0.400 in. to about 0.650 in.

These dimensions are within the design parameters of standard RF connectors, allowing the connectors of the present invention to be used in such applications. Preferably, the laminated dissimilar or explosively welded metal layers used in the RF connectors of the present invention are formed with aluminum alloy/KOVAR™ or aluminum alloy/stainless steel layers. Exemplary dissimilar metal layers for this purpose are (1) 0.060 in. aluminum alloy 4047, 0.030 in. titanium and 0.250 in. stainless steel 304L and (2) 0.075 in. aluminum alloy 4047, 0.017 in. aluminum alloy 1100 and 0.250 in. KOVAR™.

RF connectors of the present invention may be fabricated as field replaceable RF connectors. Within such embodiments, one component used in conjunction with RF connector 100 is exteriorly threaded and is fabricated to be received by RF connector interiorly threaded portion 104. (See, e.g., FIG. 2). Such threaded members are known and are commercially available. In accordance with these embodiments, RF connector 100 comprises a first metal layer 102 and a second metal layer 103 that are explosion welded, as described herein above, and interiorly threaded to receive the field replaceable component. Generally, the majority of the threads are preferably formed of the first metal layer 102, which is typically fabricated out of an iron-based metal, to minimize the problems associated with threading iron-based metal into softer metals such as, for example, aluminum or titanium alloys.

Operable connection of an exteriorly threaded member at interior threads 104 of RF connector 100 may be achieved by application of torque. Attachment of hermetic feedthru 114 may be achieved through laser welding of the ferrule portion 108 to a surface of first metal layer 102. Attachment of RF connector 100 to electronics housing package 136 may be accomplished through laser welding of second metal layer 103 to electronics housing package 136. Within certain variations of this embodiment, and depending upon the precise application contemplated, first metal layer 102 and/or second metal layer 103 may exhibit one or more laser weld flanges.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. An RF connector suitable for use in combination with a hermetically sealed lightweight electronics housing package, said RF connector comprising:

(a) a first metal layer bonded to a second metal layer;

(b) a hermetic feedthru comprising a ferrule member, a dielectric member, and a pin member, wherein said dielectric member comprises a channel to receive a first end of said pin member and wherein said ferrule member is fabricated to receive said dielectric member; and (c) a ground spring, wherein said ground spring forms a plurality of first circumferential contacts with said ferrule member and a plurality of second circumferential contacts with said electronics housing or package, thereby forming a conductive ground path between said hermetic feedthru of said RF connector and said electronics housing or package, said electronics housing or package comprising a dielectric to receive a second end of said pin member.

2. The RF connector of claim 1 wherein said first metal layer bonded to said second metal layer is bonded to a third metal layer.

3. The RF connector of claim 1 wherein said first metal layer comprises an iron-based metal.

4. The RF connector of claim 3 wherein said iron-based metal is KOVAR™.

5. The RF connector of claim 1 wherein said second metal layer comprises a metal selected from the group consisting of aluminum and titanium.

6. The RF connector of claim 1 wherein said bond between said first metal layer and said second metal layer is formed by explosion welding or roller bonding.

7. The RF connector of claim 1 wherein said ferrule member is fabricated out of a material comprising iron.

8. The RF connector of claim 1 wherein said dielectric member is fabricated out of a glass wherein said glass is selected from the group consisting of Corning Glass No. 7070 and a class having similar properties as Corning Glass No. 7070.

9. The RF connector of claim 1 wherein said pin member is fabricated out of a material comprising iron.

10. The RF connector of claim 1 wherein said electronics housing package comprises an air dielectric that receives said pin member of said RF connector.

11. The RF connector of claim 1 wherein said plurality of first circumferential contacts with said ferrule member is at points adjacent to said dielectric material.

12. The RF connector of claim 1 wherein said plurality of second circumferential contacts with said electronics housing package are at points adjacent to said dielectric of said electronics housing or package.

13. The RF connector of claim 12 wherein said dielectric of said electronics housing or package is an air dielectric.

14. The RF connector of claim 1 wherein said ground spring is fabricated from a material selected from the group consisting of stainless steel, gold-plated stainless steel, silver-plated stainless steel, and a copper alloy.

15. The RF connector of claim 14 wherein said copper alloy is a beryllium-copper alloy comprising approximately 1% beryllium and 99% copper.

16. The RF connector of claim 1 wherein said ground spring is a formed spring.

17. The RF connector of claim 16 wherein said formed ground spring interfaces directly with said electronics housing or package dielectric.

18. The RF connector of claim 1 wherein said ground spring is a coil spring.

19. An RF connector for use in combination with an electronics housing, comprising:

(a) a feedthru comprising a ferrule member, a dielectric member, and a pin member, wherein the dielectric member comprises a channel to receive a first end of the pin member, and wherein the ferrule member receives the dielectric member; and (b) a ground spring forming a plurality of first circumferential contacts with the ferrule member and a plurality of second circumferential contacts with the electronics housing.

20. The RF connector of claim 19, additionally comprising a first metal layer and a second metal layer, wherein the first metal layer comprises an iron-based metal and is laser welded to the ferrule member.

21. The RF connector of claim 20, wherein the second metal layer is laser weldable to the electronics housing.

22. The RF connector of claim 19, wherein the ground spring has:

(a) an outside diameter (OD) of between about 0.080 inches and 0.200 inches; and (b) a hole having an inside diameter (ID) of between about 0.020 inches and 0.100 inches.

23. The RF connector of claim 19, wherein the ground spring has a plurality of petals disposed at an acute angle of between about 30° and about 60° from the plane of the ground spring.

24. The RF connector of claim 19, wherein the ground spring has between about 4 petals and about 20 petals.

25. The RF connector of claim 19, wherein the ground spring comprises a conductive material selected from the group consisting of: stainless steel, gold-plated stainless steel, silver-plated stainless steel, and copper alloy.

26. The RF connector of claim 19, wherein the ground spring comprises a beryllium copper alloy.

27. The RF connector of claim 19, wherein the feedthru is a hermetic feedthru.

28. An electronics package incorporating an RF connector, wherein the RF connector has a feedthru comprising a ferrule member, a dielectric member, a pin member, and a ground spring, the dielectric member comprises a channel receiving a first end of the pin member, the ferrule member receives the dielectric member, and the ground spring forms a plurality of first circumferential contacts with the ferrule member and a plurality of second circumferential contacts with the electronics package.

29. The electronics package of claim 28, wherein the RF connector additionally comprises a first metal layer and a second metal layer, and wherein the first metal layer comprises an iron-based metal and is laser welded to the ferrule member.

30. The electronics package of claim 29, wherein the second metal layer is laser welded to the electronics package.

31. The electronics package of claim 28, wherein the ground spring comprises a plurality of petals disposed at an acute angle of between about 30° and about 60° from the plane of the ground spring.

32. The electronics package of claim 28, wherein the ground spring comprises between about 4 petals and about 20 petals.

33. The electronics package of claim 28, wherein the ground spring comprises a conductive material selected from the group consisting of: stainless steel, gold-plated stainless steel, silver-plated stainless steel, and copper alloy.

34. The electronics package of claim 28, wherein the ground spring comprises a beryllium copper alloy.

35. The electronics package of claim 28, wherein the electronics package is constructed from an aluminum alloy.

36. The electronics package of claim 28, wherein the electronics package is constructed from a material selected from the group consisting of: titanium and a titanium alloy.

37. The electronics package of claim 28, wherein the feedthru is a hermetic feedthru.

* * * * *